US011096549B2

(12) United States Patent
Rosenbauer et al.

(10) Patent No.: US 11,096,549 B2
(45) Date of Patent: Aug. 24, 2021

(54) DISHWASHER COMPRISING A MECHANISM FOR MODIFYING ODOR

(71) Applicant: BSH Hausgeräte GmbH, Munich (DE)

(72) Inventors: Michael Georg Rosenbauer, Reimlingen (DE); Karlheinz Rehm, Dischingen (DE)

(73) Assignee: BSH Hausgeräte GmbH, Munich (DE)

( * ) Notice: Subject to any disclaimer, the term of this patent is extended or adjusted under 35 U.S.C. 154(b) by 147 days.

(21) Appl. No.: 16/468,723

(22) PCT Filed: Nov. 24, 2017

(86) PCT No.: PCT/EP2017/080392
§ 371 (c)(1),
(2) Date: Jun. 12, 2019

(87) PCT Pub. No.: WO2018/108489
PCT Pub. Date: Jun. 21, 2018

(65) Prior Publication Data

US 2020/0077866 A1 Mar. 12, 2020

(30) Foreign Application Priority Data

Dec. 12, 2016 (DE) ..... 10 2016 224 729.8

(51) Int. Cl.
*A47L 15/42* (2006.01)
*A47L 15/44* (2006.01)

(52) U.S. Cl.
CPC ..... *A47L 15/4276* (2013.01); *A47L 15/424* (2013.01); *A47L 15/4242* (2013.01); *A47L 15/4481* (2013.01); *A47L 2301/04* (2013.01); *A47L 2401/20* (2013.01); *A47L 2401/26* (2013.01); *A47L 2501/16* (2013.01); *A47L 2501/22* (2013.01); *A47L 2601/08* (2013.01); *A47L 2601/10* (2013.01)

(58) Field of Classification Search
CPC ..... A47L 15/424; A47L 15/4242; A47L 15/4276; A47L 15/4481; A47L 2301/04; A47L 2401/20; A47L 2401/26; A47L 2501/16; A47L 2601/08; A47L 2601/10
USPC ..... 134/56 D, 57 D, 57 R, 58 D, 104.1
See application file for complete search history.

(56) References Cited

U.S. PATENT DOCUMENTS

2007/0131259 A1 6/2007 Classen
2008/0011329 A1 1/2008 Classen et al.
2009/0110594 A1 4/2009 Shin et al.

FOREIGN PATENT DOCUMENTS

DE 10036850 A1 10/2001
DE 102010029887 A1 12/2011
(Continued)

OTHER PUBLICATIONS

International Search Report PCT/EP2017/080392 dated Dec. 21, 2017.

*Primary Examiner* — Levon J Shahinian
(74) *Attorney, Agent, or Firm* — Michael E. Tschupp; Andre Pallapies; Brandon G. Braun

(57) ABSTRACT

A dishwasher, in particular a household dishwasher, includes a mechanism for modifying odor. The mechanism for modifying odor includes an ozone generator for odor neutralization in a dishwasher cavity and a system for fragrance introduction into the dishwasher cavity. A control device has stored therein a process, which firstly provides for the odor neutralization by the ozone generator and then introduction of a new fragrance by the system for fragrance introduction.

17 Claims, 4 Drawing Sheets

(56) References Cited

FOREIGN PATENT DOCUMENTS

| | | | |
|---|---|---|---|
| EP | 1593398 | A1 | 11/2005 |
| WO | 2013079462 | A1 | 6/2013 |

DISHWASHER COMPRISING A MECHANISM FOR MODIFYING ODOR

CROSS-REFERENCES TO RELATED APPLICATIONS

This application is the U.S. National Stage of International Application No. PCT/EP2017/080392, filed Nov. 24, 2017, which designated the United States and has been published as International Publication No. WO 2018/108489 A1 and which claims the priority of German Patent Application, Serial No. 10 2016 224 729.8, filed Dec. 12, 2016, pursuant to 35 U.S.C. 119(a)-(d).

BACKGROUND OF THE INVENTION

The present invention relates to a dishwasher with a mechanism for modifying odor.

The known problem is that after the wash cycle in the dishwasher cavity of the dishwasher has ended, a non-neutral odor prevails, which is perceived by many customers to be objectionable or unpleasant. In particular, the customer is exposed to these odors when opening a door of the dishwasher. This is produced for instance when organic components on the items to be washed are broken down by bacteria.

BRIEF SUMMARY OF THE INVENTION

One objective is therefore to save the customer from these odors as far as possible.

DE 10 2005 058 662 A1 provides that the air located in the dishwasher cavity is guided past a photocatalytic layer irradiated by a light source, on which layer the odor-forming molecules contained in the air oxidize. If, in this process, not all air is captured, unpleasant odors still remain behind. With the thus oxidized molecules, a pleasant fragrance is moreover not produced, so that so that the experience of opening the door is still not a positive one for the customer.

The problem underlying the invention is here to achieve an improvement.

The invention solves the problem by means of a household appliance having a mechanism or unit for modifying odor, the mechanism for modifying odor comprising an ozone generator for odor neutralization in the dishwasher cavity, and a system for fragrance introduction into the dishwasher cavity, and by a method of operating a mechanism or unit for modifying fragrance in a dishwasher, comprising: executing an odor neutralization by an ozone generator; and subsequently introducing a new fragrance by a system for fragrance introduction. Further advantageous embodiments and features of the invention are also disclosed.

As a result, a dual effect is achieved with the invention in that with a generic dishwasher the mechanism for modifying odor comprises at least one ozone generator and a system for fragrance introduction: on the one hand the ozone generator and the highly reactive $O_3$ molecules produced hereby achieve a neutralization of odors, in particular by oxidizing odor-forming molecules; on the other hand the system for fragrance introduction ensures that an odor perceived by the customer to be pleasant is produced, so that possible odor-forming molecules which remain even with an incomplete neutralization are overlaid by the pleasant fragrance and in each case the experience for the user is always positive.

If the system for fragrance introduction comprises a fragrance diffuser, the pleasant odors can be introduced directly into the gas phase and distributed there over a wide area, thereby producing high effectiveness with a large-volume distribution of the odors perceived to be pleasant.

In particular, the odor which can be introduced by the system for fragrance introduction can be selected by the customer, so that he himself is able to set and/or optimize the type of odor and/or intensity in accordance with his individual perceptions.

The system for fragrance introduction can advantageously be combined with a fan, in order, in this way, to be able to distribute the air applied with the fragrance perceived to be pleasant in the desired manner, for instance in the direction of the door of the dishwasher cavity to be opened.

In this regard, it is very effective if the fan is already present and can be used in particular to dry items to be washed. A further fan for modifying odor need then not be installed; the design-related effort for the achieved improvement remains minimal.

The dishwasher particularly favorably has a control device, in which a process is stored, which firstly provides the odor neutralization by means of the ozone generator and then the introduction of the new fragrance by means of the system for fragrance introduction. An elimination of the existing odors can therefore firstly be carried out, in particular an oxidation, before the new fragrances are then introduced and are then themselves not oxidized. If ozone were then further to be applied, this would run the risk of the desired new fragrance substances also being neutralized again.

It is further favorable if the carrier of the desired new fragrance can be held in the dishwasher by way of at least one cartridge. In this way a number of cartridges are also possible, from which the customer is also able to combine individual mixtures of fragrance substances.

For a simple and cost-effective design, the ozone generator can comprise, by way of example, a UV lamp for air ionization.

A method for operating a mechanism for modifying odor in a dishwasher, in which an odor neutralization firstly takes place by means of an ozone generator and then the introduction of a new fragrance takes place by means of a system for fragrance introduction, which results in the afore-cited advantages, is protected separately.

If the time instant at which the door is opened is known to the control device, in accordance with an advantageous development of the invention, it may be expedient for the air in the dishwasher cavity closed by the door firstly to be odor-neutralized by means of the ozone generator, and this odor-neutralized air is then fragranced in the dishwasher cavity closed by the door by means of the system for fragrance introduction i.e. is perfumed with one or more fragrance substances, and it is only after this that the door is opened at the predetermined time. This ensures that immediately after the time instant at which the door opens, preferably automatically by means of a door opening mechanism, the fragrancing substances can be perceived sufficiently clearly by the respective user. The door can then open in particular if the respective dishwasher program to be run is completely finished. In another variant, even before that, in particular with the start of the end section of the drying cycle, which follows on from the wash cycle, of the respective dishwasher program to be run, it can be opened before the end time instant of the dishwasher program, for drying assistance, e.g. with the aid of a door opening mechanism by an opening gap and remain open during this end section.

If, by contrast, the time instant of the door opening is not known to the control device of the dishwasher, according to an advantageous development of the invention, it may be expedient if the air in the dishwasher cavity of the dishwasher is firstly odor-neutralized by means of the ozone generator by the end of a dishwasher program to be run, in particular during its last sub-program step, preferably during the end section, i.e. immediately before the end of the drying phase of the dishwasher program to be run, before the door is opened and that it is only then and/or immediately after opening the door that the air in the dishwasher cavity, in particular the air escaping from its loading opening, is fragranced by means of the system for fragrance introduction. This ensures that the fragrancing substances can then be perceived by the user when the door is opened and/or promptly thereafter. If the fragrance substances were conversely introduced into the air of the dishwasher by means of the fragrancing system immediately after the ozonization by the end of a dishwasher program to be run, and the door was only opened manually by the user a lot later, e.g. a few hours later, these fragrancing substances in the dishwasher cavity may have already partially or fully reduced and/or evaporated.

Other developments of the invention are disclosed in the dependent claims.

The advantageous embodiments and developments of the invention described above and/or reproduced in the dependent claims can be applied individually or in any combination, except, for instance, in cases where dependencies are explicit or alternatives cannot be combined.

BRIEF DESCRIPTION OF THE DRAWINGS

The invention and its advantageous embodiments and developments as well as its advantages are described below in greater detail with reference to drawings representing exemplary embodiments. These are schematic principle sketches in which.

DETAILED DESCRIPTION OF EXEMPLARY EMBODIMENTS OF THE PRESENT INVENTION

Figure 1:
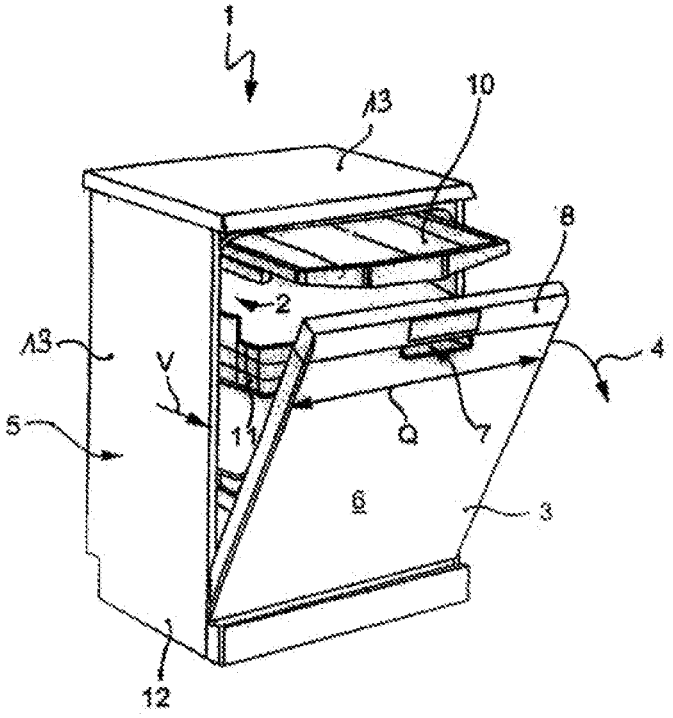
FIG. 1 shows a schematic perspective view obliquely from the front of an embodiment of a household appliance, here by way of example a dishwasher with a front door here.

The dishwasher 1 shown schematically in FIG. 1 is a household dishwasher. As a component of a partially outwardly open or closed appliance carcass 5, it has a dishwasher cavity 2 for receiving items to be washed such as dishes, pans, cutlery, glasses, cooking utensils etc. The items to be washed can be held in a racks 11 and/or a cutlery drawer 10, for instance, and in the process applied with what is known as washing liquor. Here fresh water or water circulating in particular during operation with or without detergent and/or rinse-aid and/or drying agent is understood to mean washing liquor. The dishwasher cavity 2 can have an at least substantially rectangular layout with a front side V facing a user in the operating position. Here this front side V can form a part of a kitchen front comprising kitchen furniture arranged adjacent to one another or with a standalone appliance also without reference to further furniture.

The dishwasher cavity 2 can be closed in particular on this front side V by a door 3. This door 3 is shown in FIG. 1 in a partially opened position and then inclined obliquely with respect to the vertical. In its closed position, it is by contrast upright and in accordance with the drawing with respect to its opening can be swiveled forward about a lower horizontal axis and downward in the direction of the arrow 4 so that it lies at least approximately horizontally in the completely opened position.

On its outer and front side V which are vertical in the closed position and face the user, the door 3 can be provided with a décor panel 6, in order thus to experience a visual and/or haptic enhancement and/or an adjustment to surrounding kitchen furniture.

The household appliance, here the dishwasher 1, is embodied as a standalone or as what is known as a partially integrated or also fully integrated appliance. In the latter case, the appliance carcass 5 can also end essentially with the outer walls of the dishwasher cavity 2. A housing surrounding these externally may then be unnecessary. A base 12 for receiving in particular functional elements, such as, for instance, a pump or in particular heat pump and also a fan can be disposed in the lower region of the dishwasher.

In the exemplary embodiment according to the drawing, the moveable door 3 is assigned, in its upper region, a control panel 8 which extends in the transverse direction Q of the dishwasher and which can comprise an engagement opening 7 which is accessible from the front side V for manually opening and/or closing the door 3. In the transverse direction Q, the dishwasher frequently has an extension of 45, 50 or 60 centimeters. In the depth direction from the front side V downward, the extension frequently likewise lies at approximately 60 centimeters. The values are not mandatory.

The dishwasher cavity 2 is bounded peripherally by overall, when the door 3 is closed, four vertical walls 13 and two horizontal walls 13, of which one forms a ceiling and one further one a base of the dishwasher cavity 2. The dishwasher cavity 2 is therefore tightly sealed when the door 3 is closed, so that air located therein frequently has a fairly long residence time in the small volume of the dishwasher cavity 2 which is additionally restricted by the items to be washed. This applies in particular when, after the end of the wash cycle, the door 3 is not opened immediately by the customer. As a result of the door 3 frequently opening downward in the direction of arrow 4, air escapes from the dishwasher cavity 2 frequently essentially obliquely upward and forward, in other words directly in the direction of the face of the customer opening the door.

In order to be able to influence the air located in the dishwasher cavity 2, the dishwasher 1 is assigned at least one mechanism for modifying odor, designated overall with 14. This comprises at least one ozone generator 15 and a system or device for fragrance introduction 16. At least two of the units actively influencing the air are therefore present.

Figure 2:
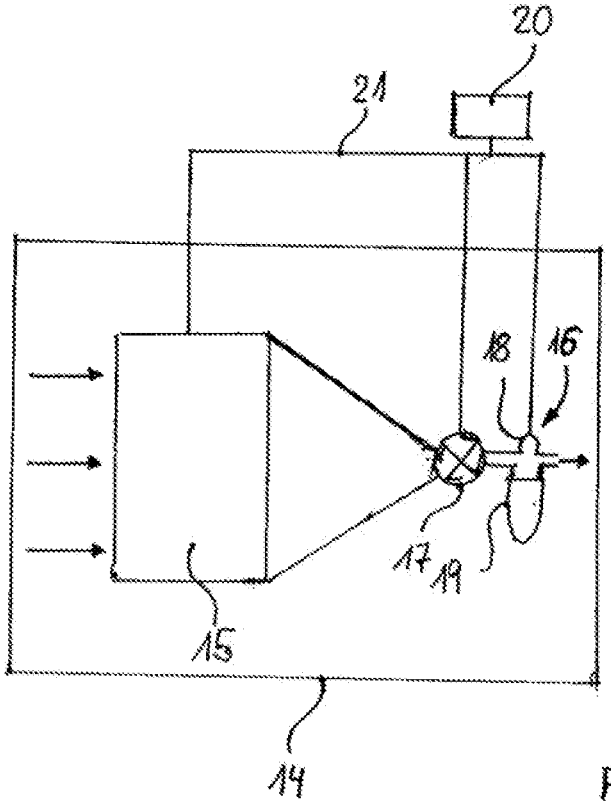
FIG. 2 shows only a schematic representation of an ozone generator with a system for fragrance introduction and a control device connected to both for the temporally defined operation of the cited mechanisms.

This mechanism 14 can act on the air in the dishwasher cavity 2, particularly at the end of a wash cycle and even before regular opening of the door 3. The mechanism 14 can therefore be arranged at different points in the dishwasher 1, the parts 15 and 16 need also not be directly adjacent to one another. The mechanism 14 advantageously uses a fan 17 (indicated schematically in FIG. 2), which circulates the air at least in the dishwasher cavity 2, and for instance can also route a line for drying disposed in a side wall 13 by using a sorption material, in particular zeolite granulate. This fan 17 is then ideally already available. The ozone generator 15 and the system for fragrance introduction 16 can also be arranged on the inner side of the door 3 or on the ceiling 13 of the dishwasher cavity 2 and face the same. The mechanism 14 can also continue to run during the door opening.

The ozone generator 15 can comprise a UV lamp for air ionization and thus form an appliance which is simple in terms of design and reliable in terms of permanent use. Other principles for ionizing and forming $O_3$ molecules from $O_2$ molecules can also be applied additionally or as an alternative.

The system for fragrance introduction 16 here comprises at least one fragrance diffusor 18, which can be fed from one, as shown here, or a number of cartridges 19, and which can spray for instance fragrance substances contained in liquid form in a finely nebulized manner.

The odor which can be introduced by the system for fragrance introduction can be selected by the customer, for instance such that cartridges 19 with different fragrances are available on the market and can be inserted individually into the dishwasher 1 by the user in accordance with his selection. It may also be possible to insert cartridges 19 with different substances into the dishwasher 1 simultaneously, and to create different mixtures in a customer-specific manner by way of an electrically actuated mixer.

Furthermore, the dishwasher has a control device or controller 20, with which, inter alia, the mechanism 14 can be actuated automatically, for instance after a wash cycle and directly at the end of a drying cycle or still overlaps with this in the end phase. A sequence program is stored in the control device 20, after which when the mechanism 14 is activated, the odor neutralization is firstly switched on by the ozone generator 15, and the introduction of the new fragrance by the system for fragrance introduction 16 is then activated. Depending on the design, both can also partially overlap in terms of time. The ozonization can also involve sterilizing the air. The control device 20 can act both on the ozone generator 15 and also on the system for fragrance introduction 16 and also possibly on the fan 17, for instance, by way of a data bus line 21. A control circuit is possible here, by a sensor system being provided on the output side of the ozone generator 15, for instance.

The fragrance modification of a dishwasher 1 is therefore operated such that an odor neutralization of existing, unpleasant odors, firstly takes place by means of an ozone generator 15 and then the introduction of a new fragrance takes place by means of a system for fragrance introduction 16. A new fragrance is therefore only "set" after the neutralization of the old, unpleasant odor. After opening the door 3, the defined odor can then be smelt, for instance. This also covers residues of the old, unpleasant odor which may still remain, if these could not be completely neutralized by means of the ozonization. Conversely, on account of the neutralization carried out previously, only a small amount of the "new" fragrance is required in order to generate a pleasant experience for the customer. The units 15 and 16 therefore provide dual protection to the customer against unpleasant odors.

If the time instant $t_{open}$ at which the front door 3 is opened is already known to the control device 20, it is particularly advantageous to largely neutralize the odor in the air in the interior of the dishwasher cavity 2 still closed by the door 3 using the ozone generator 15 and then to fragrance the odor-neutralized air in the interior of the dishwasher cavity still closed by the door using the system for fragrance introduction 16, and only then to open the door 3 at the predetermined time instant $t_{open}$. This ensures that immediately after the time instant at which the door opens, the fragrancing substances can be perceived sufficiently clearly by the respective user. The door can then open in particular if the respective dishwasher program to be run is completely finished. This corresponds to the end time instant of the dishwasher program. In another advantageous variant, the door can also be opened already, particularly at the start of the end section of the drying cycle, following on from the wash cycle, of the respective dishwasher program to be run, to assist with the drying, e.g. with the aid of a door opening mechanism, by an opening gap and remain open during this temporal end section. The door can preferably be pressed open automatically by a narrow opening gap by means of a door opening mechanism, which is actuated by the control device by way of a control line. According to another variant, the door lock can be unlocked by the control device by way of a control line, so that on account of its gravity the door then opens a bit further by itself, thereby forming a narrow opening gap. Other possibilities for automatic door opening are naturally also conceivable.

Figure 3:
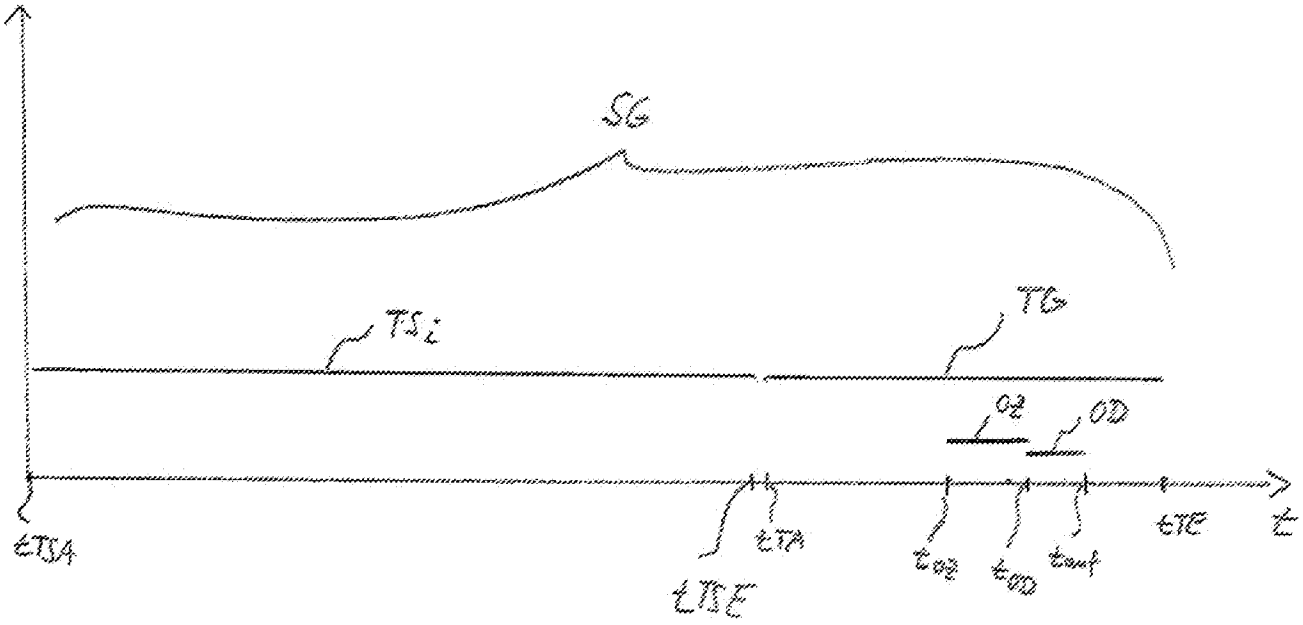
FIG. 3 shows a schematic representation of the temporal course of a dishwasher program to be run in accordance with a first advantageous fragrancing variant of the invention in the event that the time instant of the door opening is known to the control device of the dishwasher.

FIG. 3 shows a schematic representation of the temporal course of the wash cycle SG of a dishwasher program to be run in which a first advantageous fragrancing variant of the invention is also added. In this regard the control device 20 knows the time instant $t_{open}$ at which the door 3 automatically opens. In the exemplary embodiment, this is a time instant at the end time instant tTE of the drying cycle TG which follows on from the wash cycle. In particular, the opening time instant $t_{open}$ lies in the second half, preferably in the last third of the drying duration tTE-tTA of the drying cycle TG. During the end section tTE-$t_{open}$ of the drying cycle TG, which follows on from the one or more preceding liquid-conducting sub-wash cycles TSi of the wash cycle SG, the door 3 is opened to assist with the drying. The one or more liquid-conducting sub-wash cycles TSi are preferably one or more prewash cycles, a cleaning cycle which follows thereon by supplying detergent to the wash water, possibly one or more subsequent intermediate wash cycles and finally a rinse-aid cycle by dosing rinse-aid into the wash water. In the respective liquid-conducting sub-wash cycle, the one or more spray devices in the dishwasher cavity is/are used to spray fresh water or water combined with detergent or rinse-aid onto the item to be washed, to be cleaned, in the one or more receptacles, in particular cutlery drawer or basket. In the exemplary embodiment in FIG. 3, the one or more liquid-conducting sub-wash cycles start at time instant tTSA and end at the subsequent time instant tTSE. The drying cycle TG which follows on from the wash cycle then begins at time instant tTA.

If the door 3 opens at time instant $t_{open}$ during the drying cycle TG, the control device 20 is used to operate the ozone generator 15 of the odor modification mechanism 14 before time instant $t_{open}$ from time instant $t_{OZ}$ up to time instant $t_{OD}$ for a duration $t_{OD}$-$t_{OZ}$ for ozone generation and then to operate the system for fragrance introduction 16 for the purpose of perfuming the air in the dishwasher cavity from then on immediately from start time instant $t_{OD}$ up to time instant $t_{open}$. The ozone generator 15 is therefore switched on at time instant $t_{OZ}$ and switched off at time instant $t_{OD}$; the system for fragrance introduction 16 is switched on at time instant $t_{OD}$ and switched off at time instant $t_{open}$. An ozonization OZ and a subsequent fragrancing OD is therefore carried out in the immediate time section $t_{open}$-$t_{OZ}$ before the time instant $t_{open}$ of the door opening. In this way an odor or fragrance which is pleasant for the user then escapes from the interior of the dishwasher cavity when the door is opened. Since before fragrancing OD odors perceived by the user to smell bad have largely been eliminated by the temporally preceding ozonization of the air in the interior of the dishwasher cavity, the temporally immediately subsequent fragrancing using one or more fragrances perceived by the user to be pleasant can take place in an uncompromised (i.e. without exposure to bad odors) and effective manner.

If, by contrast, the time instant $t_{open}$ of the door opening is not known to the control device 20 of the dishwasher 1, in accordance with an advantageous development of the invention, it may be expedient for the air in the dishwasher cavity 2 of the dishwasher to firstly be odor-neutralized using the ozone generator 15 by the end of a dishwasher program to be run, in particular during its last sub-program step, preferably during the end section, i.e. immediately before the end of the drying phase TG of the dishwasher program to be run, before the door 3 is opened, and then only when and/or immediately after opening the door will the air in the dishwasher cavity, in particular the air escaping from its opening, be fragranced by means of the system for fragrance introduction 16. This ensures that the fragrancing substances can then be perceived by the user when the door is opened and/or promptly thereafter. If the fragrances were to be introduced into the air of the dishwasher already immediately after the ozonization by the end of a dishwasher program to be run, by means of the fragrancing system, and the door was only manually opened by the user a lot later, e.g. a few hours later, these fragrancing substances in the dishwasher cavity may have already partially or fully reduced and/or evaporated.

Figure 4:
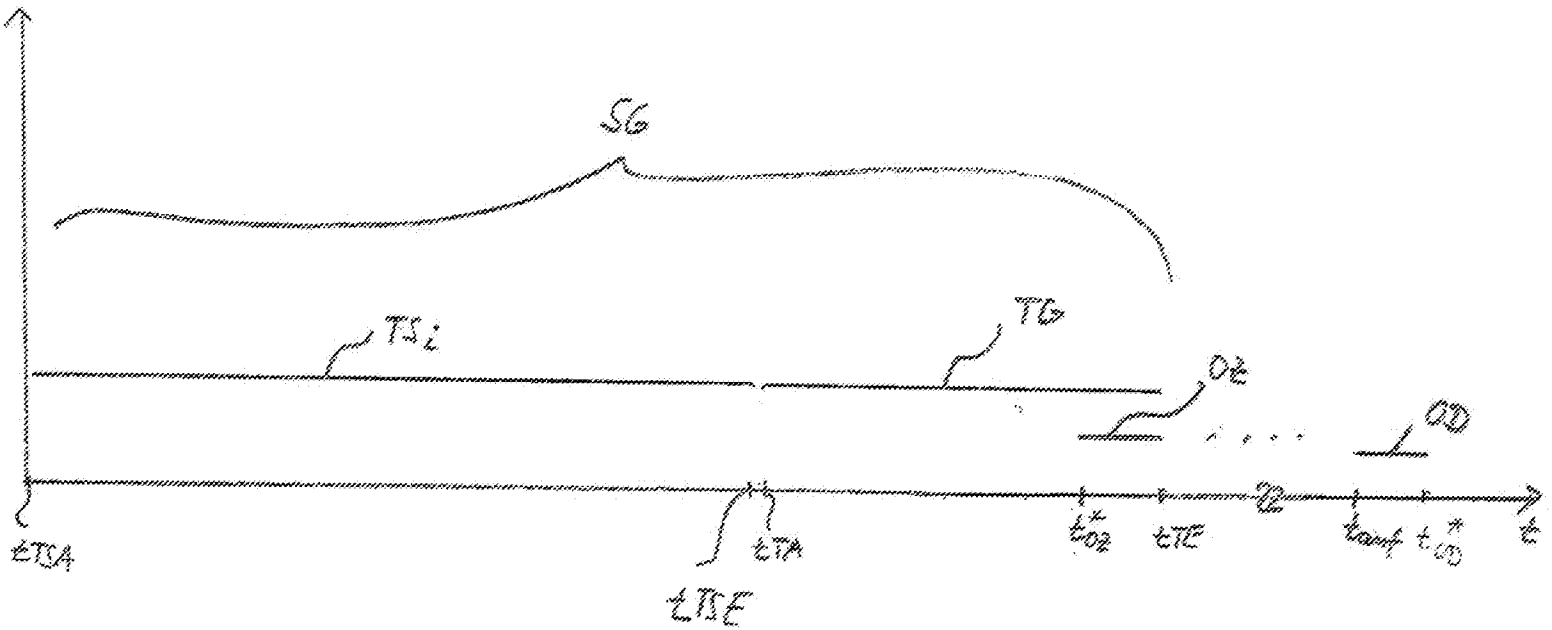
FIG. 4 shows a schematic representation of the temporal course of a dishwasher program to be run in accordance with a second advantageous fragrancing variant of the invention, in the event that the time instant of the door opening is unknown to the control device of the dishwasher.

This procedure is shown in FIG. 4 in a schematic representation. At time instant tSA, the wash cycle SG of the dishwasher program to be run starts. It ends at time instant tTE. One or more liquid-conducting sub-wash cycles TSi are firstly run as already described in the exemplary embodiment of FIG. 3. During the respective liquid-conducting sub-wash cycle, the item to be washed in the dishwasher cavity 2 is sprayed with fresh water, with water combined with detergent or with water combined with rinse-aid using one or more spray devices. A typical wash cycle has a prewash cycle, during which fresh water is applied to the item to be washed, a subsequent cleaning cycle, during which water, in particular fresh water, combined with detergent is applied to the item to be washed, and is heated to a minimum temperature, possibly at least one subsequent intermediate wash cycle with fresh water, and a subsequent rinse-aid cycle, during which water combined with rinse aid, in particular fresh water is applied to the item to be washed. After the end of the last liquid-conducting sub-wash cycle, typically the rinse-aid cycle, the drying cycle TG follows for drying the still wet items to be washed. The drying cycle starts at time instant tTA and ends at the later time instant tTE. The door 3 remains closed during the entire wash cycle SG. Shortly before the end time tTE of the drying cycle TG, the control device 20 switches on the ozone generator 15 at time instant $t_{OZ}$* for a remaining duration tTE-$t_{OZ}$* of the overall drying duration tTE-tTA and switches this off at end time tTE of the drying cycle TG, i.e. the end of the dishwasher program. Odors contained in the air in the dishwasher cavity are largely neutralized by means of this ozonization phase OZ. As a rule, some time (like e.g. even some hours) may then elapse, until the user finally opens the door 3, in particular manually, at a later time instant $t_{open}$, in order to unload the cleaned and dried items to be washed. In order now to offer the user a positive experience in terms of odor, the control device 20 switches on the system for fragrance introduction 16 for a defined period of time, so that the air in the dishwasher cavity neutralized previously with the closed door is applied with at least one fragrance which is perceived to be positive by the user. This fragrancing phase OD lasts from the time instant $t_{open}$ of opening the door for a defined duration up to time instant $t_{OD}$*. This duration $t_{OD}$*-$t_{open}$ can preferably lie in the minute range, in particular between 1 minute and 5 minutes.

With respect to both preceding embodiment variants, the duration for the ozonization OZ preferably lies in the minute range, in particular between 1 minute and 10 minutes. The duration for the fragrancing or perfuming OD is preferably in the minute range, in particular between 1 minute and 5 minutes.

The invention claimed is:

1. A dishwasher, comprising:

a dishwasher cavity;

a unit for modifying odor, said unit for modifying odor comprising an ozone generator for odor neutralization in the dishwasher cavity, and a system for fragrance introduction into the dishwasher cavity: and a controller configured to control the unit for modifying odor such that at first an odor within the dishwasher cavity is neutralized by the ozone generator, and only afterwards is the system for fragrance introduction into the dishwasher cavity subsequently activated by the controller to flow a new fragrance into the dishwasher cavity.

2. The dishwasher of claim 1, constructed in the form of a household dishwasher.

3. The dishwasher of claim 1, wherein the system for fragrance introduction comprises a fragrance diffusor.

4. The dishwasher of claim 1, wherein the system for fragrance introduction is configured to enable a customer to select odor.

5. The dishwasher of claim 1, further comprising a fan configured for cooperation with the system for fragrance introduction.

6. The dishwasher of claim 5, wherein the fan is already present and configured for drying items to be washed.

7. The dishwasher of claim 1, further comprising a cartridge held in the dishwasher and forming a fragrance carrier.

8. The dishwasher of claim 1, wherein the ozone generator comprises a UV lamp for air ionization.

9. A method of operating a unit for modifying fragrance in a dishwasher, comprising:

executing an odor neutralization by using a controller to first activate an ozone generator; and only then subsequently introducing a new fragrance by using the controller to activate a system for fragrance introduction.

10. The method of claim 9, wherein when a time instant of opening a door to a dishwasher cavity is known to the controller of the dishwasher, the odor neutralization is executed by the ozone generator, prior to the time instant, by odor neutralizing air in the dishwasher cavity closed by the door, and the thus odor-neutralized air in the closed dishwasher cavity is fragranced by the system for fragrance introduction, and further comprising opening the door at the predetermined time instant only after the odor-neutralized air has been fragranced.

11. The method of claim 10, wherein the odor neutralization is executed by the ozone generator immediately prior to the time instant of the door opening.

12. The method of claim 10, wherein the odor neutralization is executed by the ozone generator during a last sub-program step of a drying step of a dishwasher program to be run.

13. The method of claim 10, wherein the odor neutralization is executed by the ozone generator during an end section of a drying step of a dishwasher program to be run.

14. The method of claim 9, wherein when a time instant of opening a door to a dishwasher cavity is not known to the controller of the dishwasher, the odor neutralization is executed by the ozone generator by odor neutralizing air in the dishwasher cavity by an end of a dishwasher program to be run before the door is opened, and the air in the dishwasher cavity is then fragranced by the system for fragrance introduction only during or immediately after opening the door.

15. The method of claim 14, wherein the odor neutralization is executed by the ozone generator during a last sub-program step of a drying step of the dishwasher program.

16. The method of claim 14, wherein the odor neutralization is executed by the ozone generator during an end section of a drying step of dishwasher program.

17. The method of claim 14, wherein the air being fragranced is air escaping from a loading opening of the dishwasher cavity.

* * * * *